US011349242B2

(12) United States Patent
Teramoto

(10) Patent No.: US 11,349,242 B2
(45) Date of Patent: May 31, 2022

(54) MALE WIRE TERMINAL AND MALE WIRE CONNECTOR

(71) Applicant: SUMITOMO WIRING SYSTEMS, LTD., Mie (JP)

(72) Inventor: Keisuke Teramoto, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/027,880

(22) Filed: Sep. 22, 2020

(65) Prior Publication Data

US 2021/0098917 A1 Apr. 1, 2021

(30) Foreign Application Priority Data

Sep. 30, 2019 (JP) ..... JP2019-179037

(51) Int. Cl.

| | |
|---|---|
| ***H01R 13/11*** | (2006.01) |
| ***H01R 13/642*** | (2006.01) |
| ***H01R 13/04*** | (2006.01) |
| ***H01R 13/629*** | (2006.01) |
| ***H01R 13/42*** | (2006.01) |

(52) U.S. Cl.

CPC ..... *H01R 13/113* (2013.01); *H01R 13/04* (2013.01); *H01R 13/42* (2013.01); *H01R 13/629* (2013.01); *H01R 13/642* (2013.01)

(58) Field of Classification Search

CPC ..... H01R 13/04; H01R 13/113; H01R 13/42; H01R 13/5045; H01R 13/642; H01R 13/629; H01R 13/432; H01R 13/516; H01R 43/16

See application file for complete search history.

(56) References Cited

U.S. PATENT DOCUMENTS 6,551,151 B2 * 4/2003 Suzuki ..... H01R 13/055 439/866

6,811,436 B2 11/2004 Tabata

* cited by examiner

*Primary Examiner* — Vanessa Girardi

(74) *Attorney, Agent, or Firm* — Abelman, Frayne & Schwab

(57) ABSTRACT

A male terminal to be accommodated into a cavity of a housing includes a plate-like tab formed in a front end part, and a box portion in the form of a rectangular tube connected to a rear part of the tab and open rearward. A front end part of the box portion includes a contact portion configured to come into contact with an inner wall of the cavity from behind and a supporting portion located behind the contact portion. The contact portion has a contact surface constituted by a plate surface of a metal plate material constituting the box portion and the contact surface comes into contact with the inner wall of the cavity. The supporting portion supports the contact portion 44 from a side opposite to the contact surface when the contact portion comes into contact with the inner wall of the cavity.

5 Claims, 8 Drawing Sheets

MALE WIRE TERMINAL AND MALE WIRE CONNECTOR

CROSS-REFERENCE TO RELATED APPLICATIONS

This application is based on and claims priority from Japanese Patent Application No. 2019-179037, filed on Sep. 30, 2019, with the Japan Patent Office, the disclosure of which is incorporated herein in their entireties by reference.

TECHNICAL FIELD

The present disclosure relates to a male terminal and a male connector.

BACKGROUND

Japanese Patent Laid-open Publication No. 2003-243065 describes a connector with a male terminal fitting. A cavity of the connector is provided with a receiving surface substantially orthogonal to an inserting direction of the male terminal fitting. The male terminal fitting is provided with a contact surface substantially orthogonal to the inserting direction thereof. The male terminal fitting includes a tab projecting forward from the front end of a rectangular tube portion. The contact surface is provided on the front end edge of the rectangular tube portion.

The male terminal fitting inserted into the cavity is stopped in front by the contact of the contact surface thereof with the receiving surface in the cavity substantially in the same direction as the inserting direction thereof. Thus, the male terminal fitting can be reliably stopped in front at a predetermined proper insertion position.

SUMMARY

In recent years, the miniaturization of male terminals and male connectors has been required. For the miniaturization of a male terminal, it is, for example, considered to make a metal plate material constituting the male terminal thinner than before. If the metal plate material is thinned, the metal plate material constituting a rectangular tube portion may buckle when a contact surface comes into contact with a receiving surface of a housing in the case where the contact surface is provided on the front end edge of the rectangular tube portion. Then, there is a problem that the male terminal cannot be stopped in front with respect to a male connector.

The present disclosure was completed on the basis of the above situation and aims to reliably stop a male terminal in front.

The present disclosure is directed to a male terminal to be accommodated into a cavity of a housing, the male terminal including a plate-like tab formed in a front end part, and a box portion in the form of a rectangular tube connected to a rear part of the tab and open rearward, wherein a front end part of the box portion includes a contact portion configured to come into contact with an inner wall of the cavity from behind and a supporting portion located behind the contact portion, the contact portion has a contact surface constituted by a plate surface of a metal plate material constituting the box portion and the contact surface comes into contact with the inner wall of the cavity, and the supporting portion supports the contact portion from a side opposite to the contact surface when the contact portion comes into contact with the inner wall of the cavity.

According to the present disclosure, the male terminal can be reliably stopped in front with respect to the housing.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
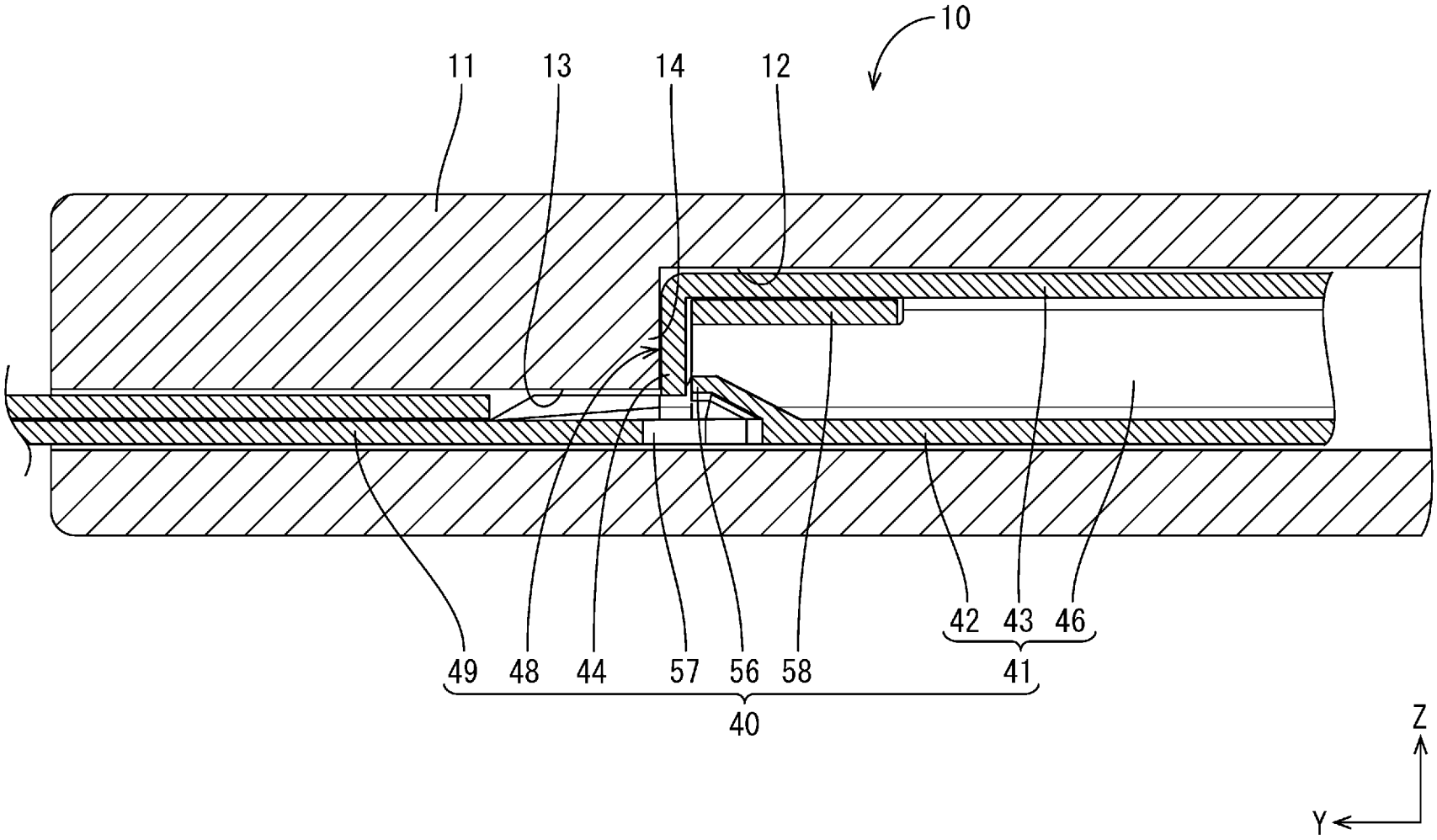
FIG. 1 is a section along I-I in FIG. 2 showing a male connector according to one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

DESCRIPTION OF EMBODIMENTS OF PRESENT DISCLOSURE

First, embodiments of the present disclosure are listed and described.

(1) The present disclosure is directed to a male terminal to be accommodated into a cavity of a housing, the male terminal including a plate-like tab formed in a front end part, and a box portion in the form of a rectangular tube connected to a rear part of the tab and open rearward, wherein a front end part of the box portion includes a contact portion configured to come into contact with an inner wall of the cavity from behind and a supporting portion located behind the contact portion, the contact portion has a contact surface constituted by a plate surface of a metal plate material constituting the box portion and the contact surface comes into contact with the inner wall of the cavity, and the supporting portion supports the contact portion from a side opposite to the contact surface when the contact portion comes into contact with the inner wall of the cavity.

Since the contact surface constituted by the plate surface of the metal plate material constituting the box portion comes into contact with the inner wall of the cavity, a wide area of a part in contact with the inner wall of the cavity can be secured. In this way, the buckling of the contact portion is suppressed, wherefore the male terminal can be reliably stopped in front in the cavity of the housing.

Further, when the contact portion comes into contact with the inner wall of the cavity to be pressed rearward, the supporting portion supports the contact portion, whereby the buckling of the contact portion is further suppressed. In this way, the male terminal can be more reliably stopped in front in the cavity of the housing.

(2) The contact portion is preferably formed by bending a part of a side wall constituting the box portion.

Since the contact portion can be formed by a simple method of bending the part of the side wall constituting the box portion, an increase in the manufacturing cost of the male terminal can be suppressed.

(3) The supporting portion is preferably formed by cutting and raising a part of a side wall constituting the box portion.

Since the supporting portion can be formed by a simple method of cutting and raising the part of the side wall constituting the box portion, an increase in the manufacturing cost of the male terminal can be suppressed.

(4) One side wall of the box portion formed with the contact portion and another side wall of the box portion formed with the supporting portion are preferably facing each other.

By respectively providing the contact portion and the supporting portion on different side walls of the box portion, a force received by the contact portion can be reliably received by the supporting portion. Further, since the one side wall formed with the contact portion and the other side wall formed with the supporting portion are arranged to face each other, it is suppressed that the force received by the contact portion affects the supporting portion by being transferred through the side walls of the box portion. In this way, the contact portion can be reliably supported by the supporting portion.

(5) The present disclosure is directed to a male connector with any one of the above male terminals and a housing including a cavity for accommodating the male terminal, a contact wall configured to come into contact with the contact portion from front being formed on an inner wall of the cavity of the housing.

By the contact of the contact wall of the housing and the contact portion of the male terminal, the male terminal can be reliably stopped in front with respect to the housing.

DETAILS OF EMBODIMENTS OF PRESENT DISCLOSURE

Hereinafter, an embodiment of the present disclosure is described. The present invention is not limited to these illustrations and is intended to be represented by claims and include all changes in the scope of claims and in the meaning and scope of equivalents.

EMBODIMENT

One embodiment of the present disclosure is described with reference to FIGS. 1 to 8. A male connector 10 of this embodiment includes a housing 11 and a male terminal 40. In the following description of the male terminal 40, a direction indicated by an arrow Z, a direction indicated by an arrow Y and a direction indicated by an arrow X are referred to as an upward direction, a forward direction and a leftward direction in figures. Further, for a plurality of identical members, only some may be denoted by a reference sign and the others may not be denoted by the reference sign.

[Housing 11]

The housing 11 is made of insulating synthetic resin and, as shown in FIG. 1, a cavity 12 is formed to be open in a front-rear direction of the housing 11 inside the housing 11. A tab insertion hole 13 open forward is formed in a front wall of the cavity 12. The tab insertion hole 13 communicates with the cavity 12. A vertical height of the tab insertion hole 13 is smaller than that of the cavity 12.

A part of the front wall of the housing 11 above the tab insertion hole 13 serves as a contact wall (an example of an inner wall) 14 configured to come into contact with a contact portion 44 to be described later. The rear surface of the contact wall 14 is formed to extend in a vertical direction.

Figure 2:
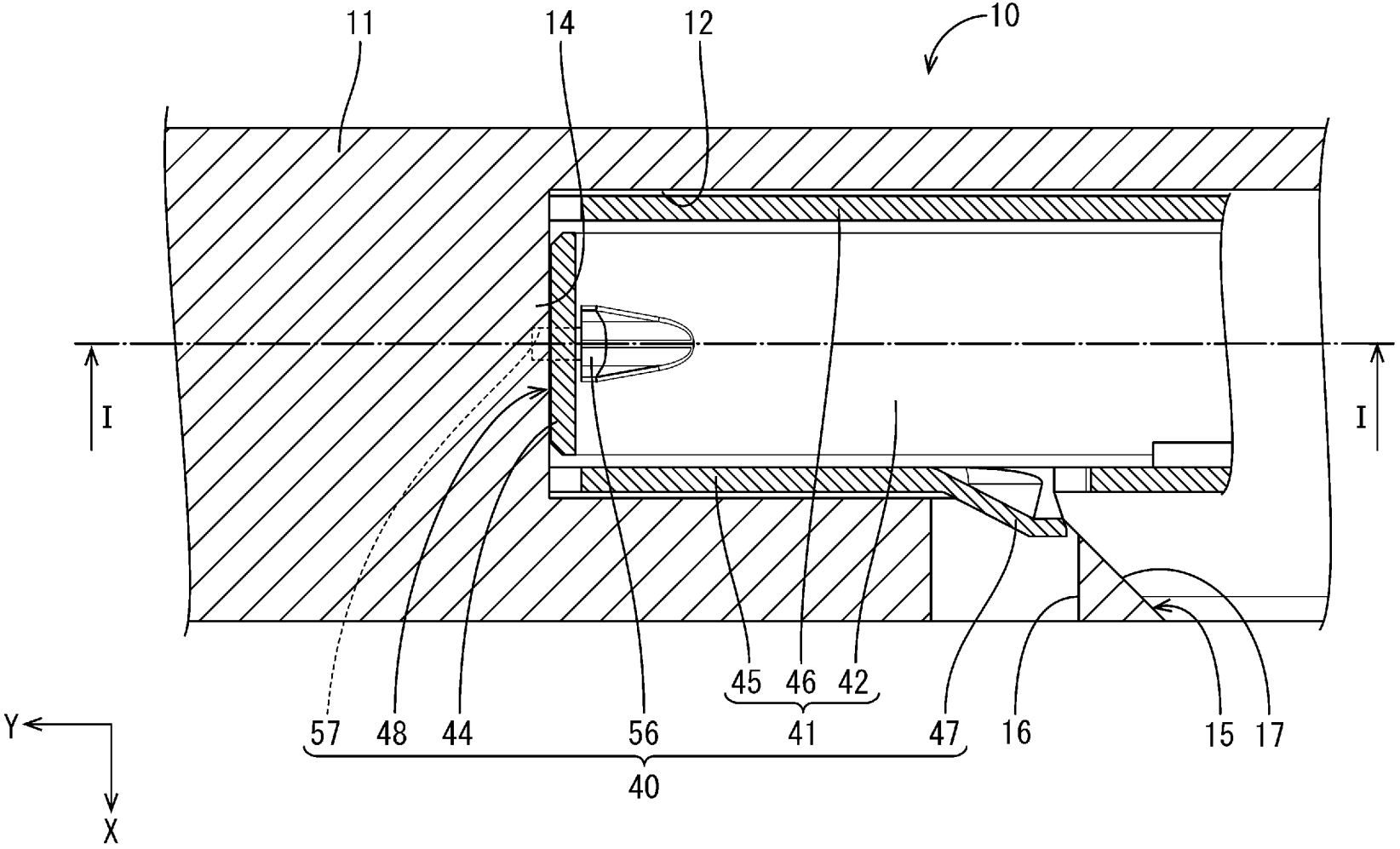
FIG. 2 is a section along II-II in FIG. 5 showing the male connector.

As shown in FIG. 2, the housing 11 is formed with a front opening 16 open leftward at a position near a rear part of the cavity 12. As shown in FIG. 2, the housing 11 is formed with a rear opening 17 open leftward behind the front opening 16. In this way, the cavity 12 is shaped to be open leftward.

As shown in FIG. 2, a guiding slope 15 inclined obliquely rearward toward the left is formed on the front end edge of the rear opening 17. This guiding slope 15 and a locking portion 47 to be described later slide in contact with each other.

[Male Terminal 40]

Figure 3:
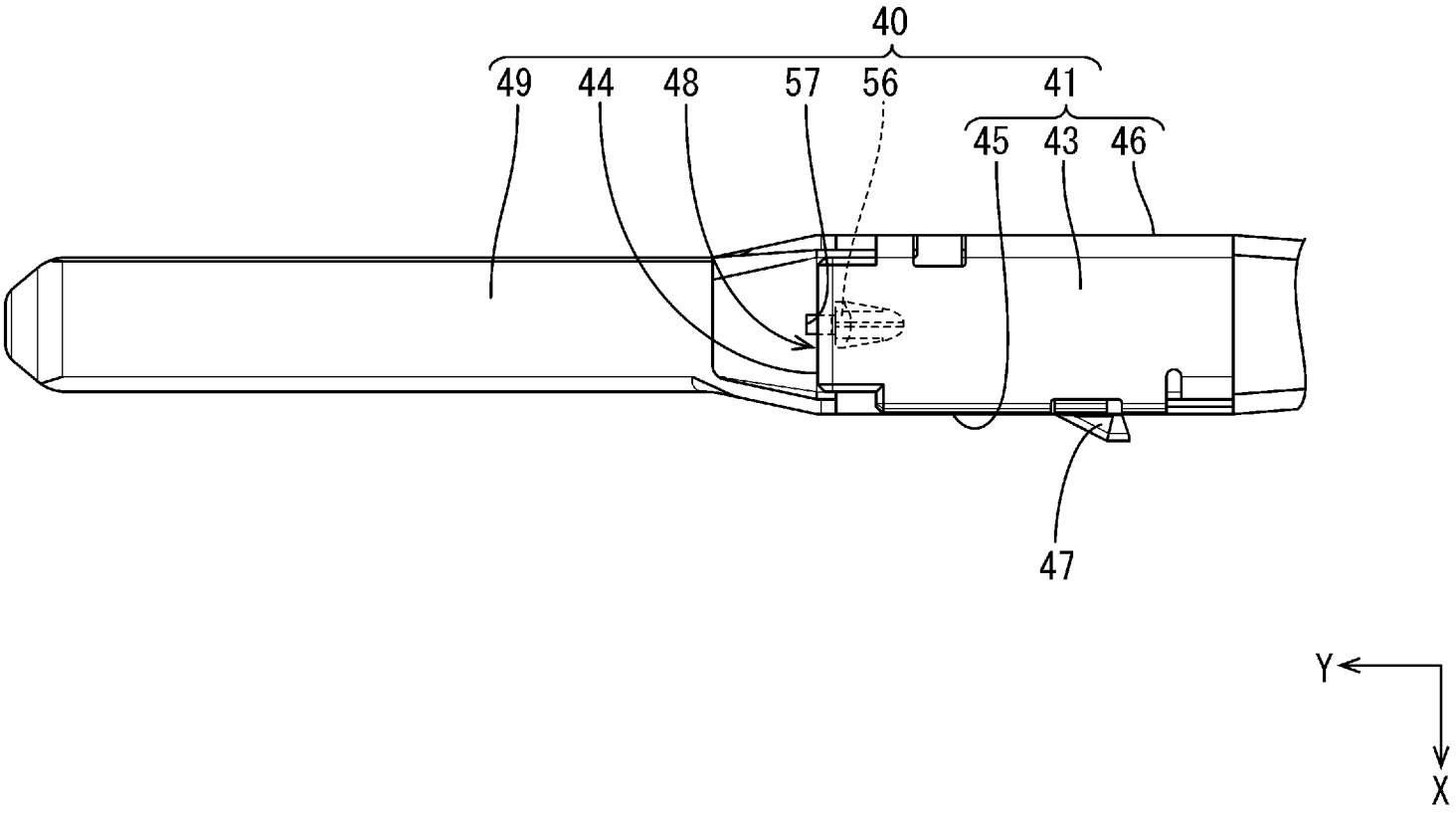
FIG. 3 is a plan view showing a male terminal.

As shown in FIG. 3, the male terminal 40 is formed by bending a metal plate material stamped into a predetermined shape, and elongated in the front-rear direction as a whole. An arbitrary metal such as copper, copper alloy, aluminum or aluminum alloy can be selected as the metal plate material.

As shown in FIG. 3, a tab 49 elongated forward is formed in a front end part of the male terminal 40. The tab 49 is connected to an unillustrated mating female terminal. The tab 49 is formed to be flat in the vertical direction.

As shown in FIG. 3, a substantially central part in a length direction of the male terminal 40 serves as a box portion 41. The box portion 41 extends in the front-rear direction and is in the form of a rectangular tube flat in the vertical direction as a whole. The front surface of the box portion 41 is closed by a front wall. The box portion 41 includes a bottom wall 42, a left side wall 46 and a right side wall 46 extending upward from both left and right side edges of the bottom wall 42 and an upper wall 43 bent from an upper end part of the right side wall 46 and locked to an upper end part of the left side wall 45.

Figure 4:
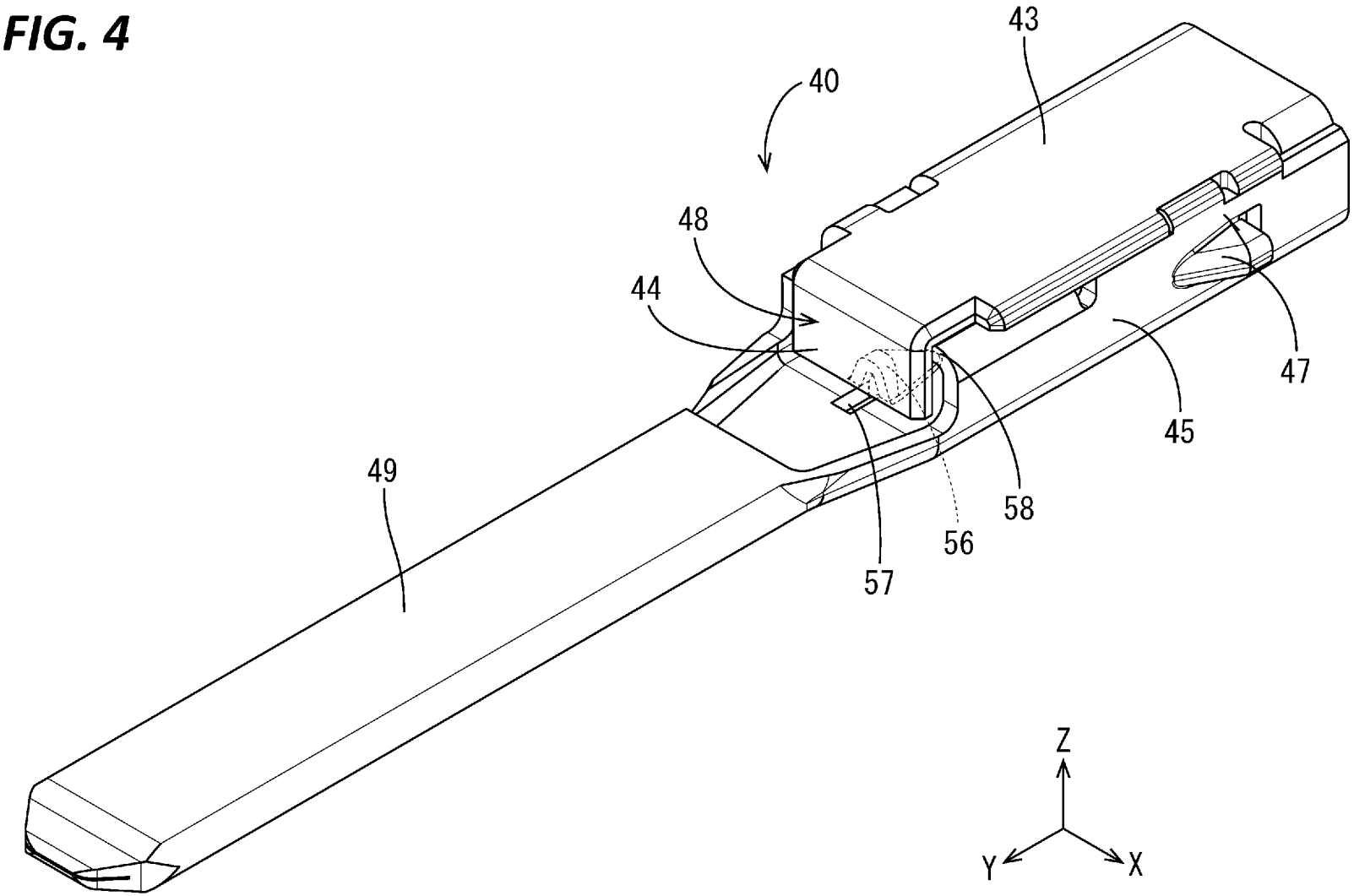
FIG. 4 is a partial enlarged perspective view showing the male terminal.
Figure 5:
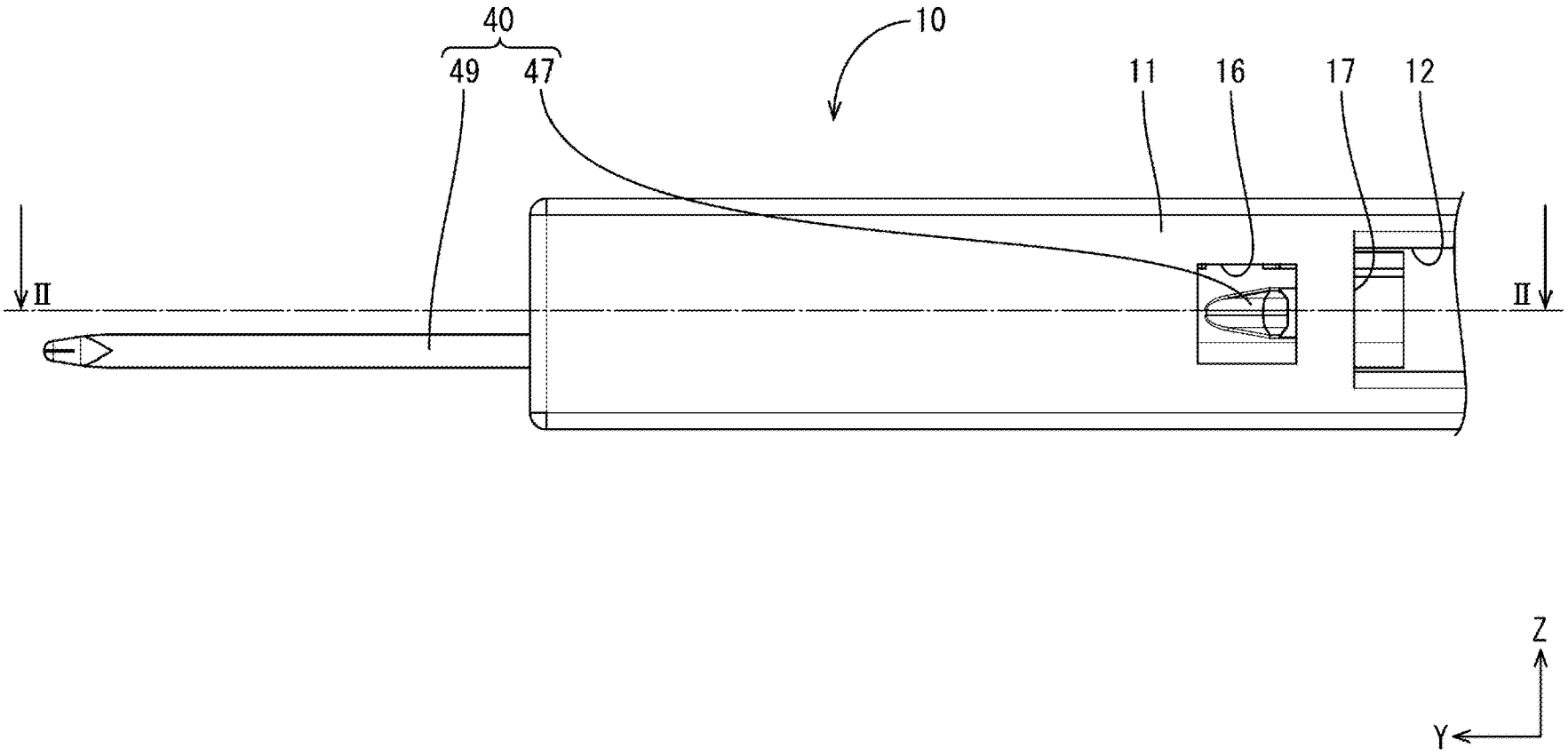
FIG. 5 is a partial enlarged side view showing the male connector.

As shown in FIG. 4, the locking portion 47 projecting leftward is formed at a position near a rear end part of the left side wall 45 of the box portion 41. The locking portion 47 is formed by striking the metal plate material constituting the left side wall 45. The front surface of the locking portion 47 is inclined obliquely rearward toward the left. In this way, the front surface of the locking portion 47 smoothly slides in contact with the guiding slope 15 of the housing 11. The rear surface of the locking portion 47 is formed to be steep and overhang. In this way, as shown in FIGS. 2 and 5, the locking portion 47 is locked to a rear wall of the front opening 16 from front when being fit into the front opening 16, whereby the male terminal 40 is held in the housing 11 not to come out rearward.

Although not shown in detail, a wire connecting portion to which a wire is to be connected is provided on the rear end of the box portion 41. A connecting structure of the wire and the wire connecting portion is not particularly limited and an arbitrary method such as crimping, insulation displacement, soldering or welding can be used.

[Contact Portion 44]

Figure 6:
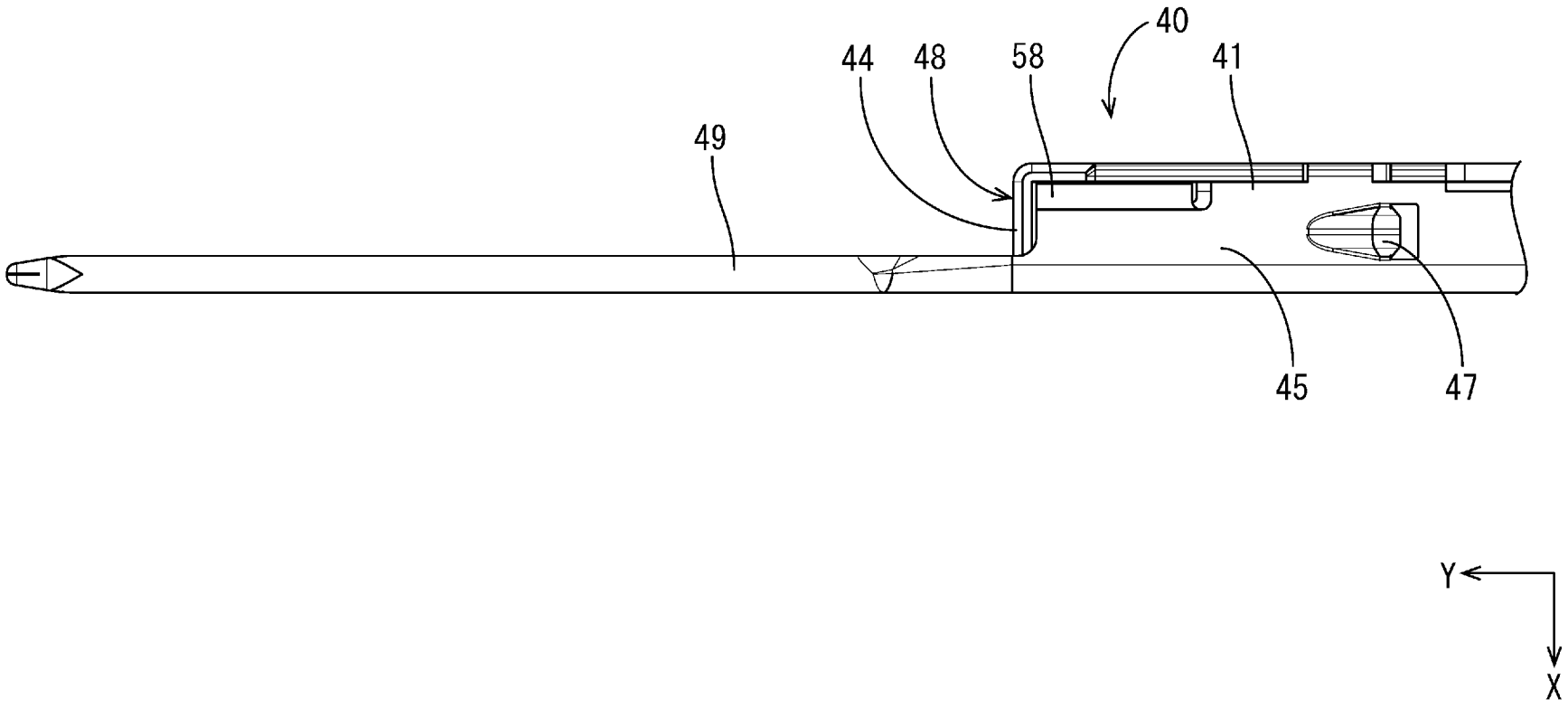
FIG. 6 is a partial enlarged side view showing the male terminal.

As shown in FIGS. 4 and 6, the contact portion 44 bent downward is formed on a front end part of the upper wall 43 of the box portion 41. As shown in FIG. 1, a lower end part of the contact portion 44 extends up to substantially the same height position as the upper surface of the tab 49. A lateral width of the contact portion 44 is set somewhat smaller than a width between the left and right side walls 45 and 46.

As shown in FIG. 1, the contact portion 44 is bent substantially at a right angle to the upper wall 43. A substantially right angle means a right angle and also angles that can be certified as a right angle although not being a right angle. The front surface of the contact portion 44 serves as a contact surface 48 configured to come into contact with the rear surface of the contact wall 14 of the housing 11 from behind. The contact surface 48 and the rear surface of the contact wall 14 are formed to come into surface contact with each other.

Figure 7:
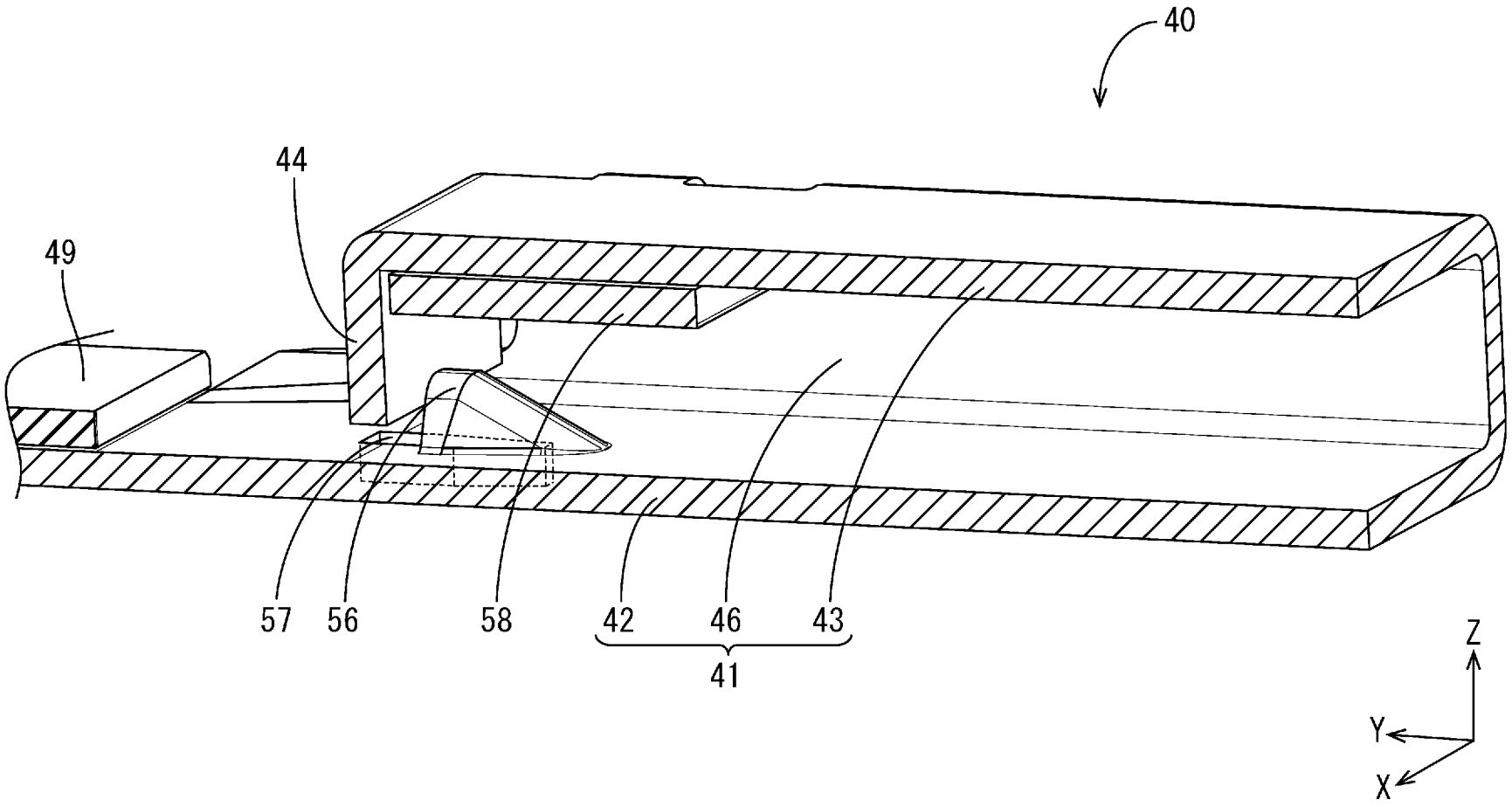
FIG. 7 is a partial enlarged perspective view in section showing a contact portion and a supporting portion.
Figure 8:
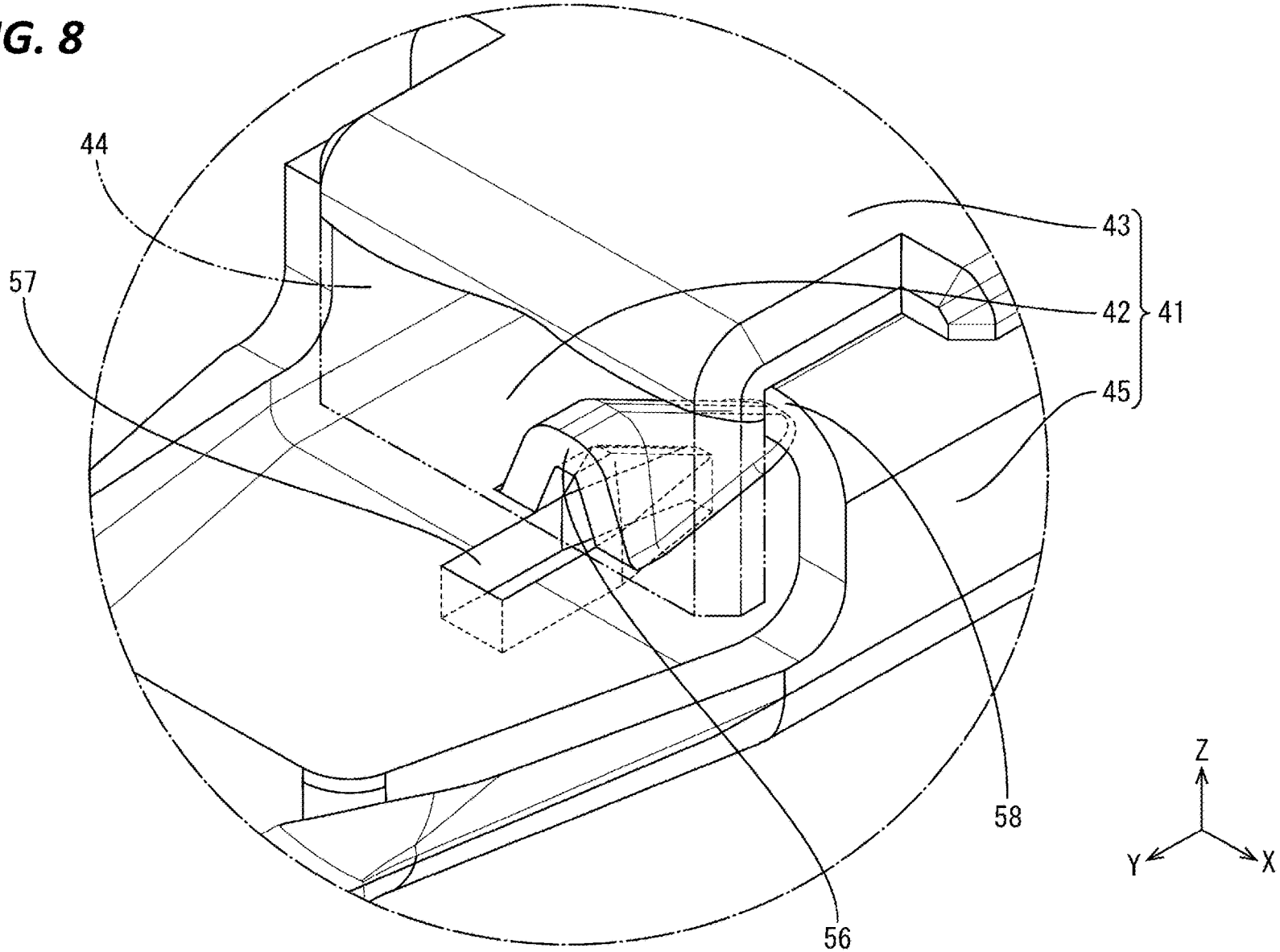
FIG. 8 is a partial enlarged perspective view showing the contact portion and the supporting portion.

As shown in FIG. 7, an auxiliary supporting portion 58 is disposed at a position below the upper wall 43 and behind the contact portion 44. As shown in FIGS. 6 and 8, the auxiliary supporting portion 58 is formed by being bent rightward from the upper end part of the left side wall 45. The auxiliary supporting portion 58 comes into contact with the contact portion 44 from behind to support the contact portion 44 when the contact portion 44 is deflected and deformed rearward.

[Supporting Portion 56]

As shown in FIG. 1, the supporting portion 56 projecting upward is formed at a position near a front end part of the bottom wall 42. As shown in FIG. 4, the supporting portion 56 is formed near a center position in the lateral direction of the bottom wall 42. As shown in FIG. 8, a front end part of the supporting portion 56 is formed into a chevron shape when viewed from front.

As shown in FIG. 1, an upper end part of the supporting portion 56 is disposed at a position above the lower end part of the contact portion 44. In this way, the upper end part of the supporting portion 56 can contact the contact portion 44 from behind when the contact portion 44 is deflected and deformed rearward.

As shown in FIG. 1, the supporting portion 56 is formed to be highest at the front end part and inclined downward toward the rear from the front end part when viewed laterally. As shown in FIGS. 1 and 8, the bottom wall 42 is formed with a through hole 57 at a position in front of the supporting portion 56. By forming this through hole 57, the supporting portion 56 is easily processed in striking the supporting portion 56.

[Assembly Process of Male Connector 10]

Next, an example of an assembly process of the male connector 10 is described. The assembly process of the male connector 10 is not limited to that described below.

The male terminal 40 is inserted into the cavity 12 of the housing 11 from behind. By pushing the male terminal 40 further forward, the front end part of the tab 49 reaches the tab insertion hole 13.

The front end part of the tab 49 is inserted into the tab insertion hole 13 from behind. If the male terminal 40 is further pushed forward, the contact surface 48 of the contact portion 44 of the male terminal 40 comes into surface contact with the contact wall 14 of the housing 11 from behind as shown in FIG. 1. In this way, the male terminal 40 is held in a front stop state in the cavity 12. If the contact portion 44 is going to be deflected and deformed rearward by being pushed by the contact wall 14, the supporting portion 56 provided behind the contact portion 44 contacts the contact portion 44 from behind to suppress rearward deflection and deformation of the contact portion 44.

On the other hand, the locking portion 47 slides in contact with the guiding slope 15 of the housing 11, thereby being guided into the front opening 16 as shown in FIG. 2. In the front opening 16, the locking portion 47 is locked to a hole edge part of the front opening 16 from front. In this way, the male terminal 40 is held in a rear stop state in the cavity 12.

Next, functions and effects of this embodiment are described. This embodiment relates to the male terminal 40 to be accommodated into the cavity 12 of the housing 11, the male terminal 40 includes the plate-like tab 49 formed in the front end part and the box portion 41 in the form of a rectangular tube connected to a rear part of the tab 49 and open rearward, the front end part of the box portion 41 includes the contact portion 44 configured to come into contact with the contact wall 14 of the cavity 12 from behind and the supporting portion 56 located behind the contact portion 44, the contact portion 44 has the contact surface 48 constituted by a plate surface of the metal plate material constituting the box portion 41, the contact surface 48 comes into contact with the contact wall 14 of the cavity, and the supporting portion 56 supports the contact portion 44 from a side opposite to the contact surface 48 when the contact portion 44 comes into contact with the contact wall 14 of the cavity 12.

Since the contact surface 48 constituted by the plate surface of the metal plate material constituting the box portion 41 comes into contact with the contact wall 14 of the cavity 12, a wide area of a part where the contact portion 44 is in contact with the contact wall 14 of the cavity 12 can be secured. In this way, the buckling of the contact portion 44 is suppressed, wherefore the male terminal 40 can be reliably stopped in front in the cavity 12 of the housing 11.

Further, when the contact portion 44 comes into contact with the contact wall 14 of the cavity 12 to be pressed rearward, the supporting portion 56 supports the contact portion 44 from behind, whereby the buckling of the contact portion 44 is further suppressed. In this way, the male terminal 40 can be reliably stopped in front in the cavity 12 of the housing 11.

Further, according to this embodiment, the contact portion 44 is formed by bending a part of the upper wall 43 constituting the box portion 41.

Since the contact portion 44 can be formed by a simple method of bending the part of the upper wall 43 constituting the box portion 41, an increase in the manufacturing cost of the male terminal 40 can be suppressed.

Further, according to this embodiment, the supporting portion 56 is formed by cutting and raising a part of the bottom wall 42 constituting the box portion 41.

Since the supporting portion 56 can be formed by a simple method of cutting and raising the part of the bottom wall 42 constituting the box portion 41, an increase in the manufacturing cost of the male terminal 40 can be suppressed.

Further, according to this embodiment, the upper wall 43 of the box portion 41 formed with the contact portion 44 and the bottom wall 42 of the box portion 41 formed with the supporting portion 56 are facing each other.

By respectively providing the contact portion 44 and the supporting portion 56 on different walls of the box portion 41, a force received by the contact portion 44 can be reliably received by the supporting portion 56. Further, since the upper wall 43 formed with the contact portion 44 and the bottom wall 42 formed with the supporting portion 56 are arranged to face each other, it is suppressed that the force received by the contact portion 44 affects the supporting portion 56 by being transferred through the side walls of the box portion 41. In this way, the contact portion 44 can be reliably supported by the supporting portion 56.

Further, the male connector 10 according to this embodiment is provided with the male terminal 40 and the housing 11 including the cavity 12 for accommodating the male terminal 40, and the cavity 12 of the housing 11 is formed with the contact wall 14 configured to come into contact with the contact portion 44 from front.

By the contact of the contact wall 14 of the housing 11 and the contact portion 44 of the male terminal 40, the male terminal 40 can be reliably stopped in front with respect to the housing 11.

OTHER EMBODIMENTS (1) A plurality of the male terminals 40 may be accommodated in one male connector 10.

(2) Although the contact portion 44 is substantially orthogonal to the upper wall 43 of the box portion 41 in this embodiment, there is no limitation to this and the contact portion 44 may extend in a direction intersecting the plate surface of the upper wall 43 of the box portion 41.

(3) The contact portion 44 may be formed by folding the front end edge of the left side wall 45 rightward or may be formed by folding the front end edge of the right side wall 46 leftward.

(4) The locking portion 47 may be formed on the right side wall of the box portion 41.

(5) Although the supporting portion 56 is formed on the bottom wall 42 in this embodiment, there is no limitation to this and the supporting portion 56 may be formed on the left side wall 45 or on the right side wall 46.

(6) The shape of the supporting portion 56 is not limited and can be an arbitrary shape such as a shape obtained by cutting and raising the front end edge of the bottom wall 42 obliquely upward toward the front.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A male terminal to be accommodated into a cavity of a housing, comprising:

a plate-like tab formed in a front end part; and a box portion in the form of a rectangular tube connected to a rear part of the tab and open rearward, wherein:

a front end part of the box portion includes a contact portion configured to come into contact with an inner wall of the cavity from behind and a supporting portion located behind the contact portion, the contact portion has a contact surface constituted by a plate surface of a metal plate material constituting the box portion and the contact surface comes into contact with the inner wall of the cavity, the supporting portion supports the contact portion from a side opposite to the contact surface when the contact portion comes into contact with the inner wall of the cavity, and projects toward an upward direction at a position near a front end part of a bottom wall constituting the box portion, the contact portion is formed by bending an upper wall constituting the box portion, and the upper wall of the box portion formed with the contact portion and the bottom wall of the box portion formed with the supporting portion are facing each other.

2. A male connector, comprising:

the male terminal of claim 1; and a housing including a cavity for accommodating the male terminal, a contact wall configured to come into contact with the contact portion from front being formed on an inner wall of the cavity of the housing.

3. The male terminal of claim 1, wherein the housing is formed with a front opening open laterally at a position near a rear part of the cavity and a rear opening laterally behind the front opening, and a guiding slope inclined obliquely rearward toward a side is formed on a front end edge of the rear opening, and a locking portion projects outward at a position near a rear end part of a side wall constituting the box portion and slides in contact with the guiding slope.

4. The male terminal of claim 1, further comprising:

an auxiliary supporting portion disposed at a position below the upper wall and behind the contact portion.

5. The male terminal of claim 4, wherein the auxiliary supporting portion is formed by being bent inward from an upper end part of a side wall constituting the box portion.

* * * * *